US006679330B1

(12) United States Patent
Compton et al.

(10) Patent No.: US 6,679,330 B1
(45) **Date of Patent: *Jan. 20, 2004**

(54) TUBING HANGER WITH BALL VALVE

(75) Inventors: Dewey Craig Compton, Richmond, TX (US); Edwin R. Knerr, Houston, TX (US)

(73) Assignee: Kvaerner Oilfield Products, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/014,971

(22) Filed: Oct. 26, 2001

(51) Int. Cl.[7] ..... E21B 33/047; E21B 34/04

(52) U.S. Cl. ..... 166/348; 166/97.5; 166/87.1; 166/368

(58) Field of Search ..... 166/348, 368, 166/87.1, 86.1, 75.14, 97.5

(56) References Cited

U.S. PATENT DOCUMENTS

| | | | | | |
|---|---|---|---|---|---|
| 3,360,048 | A | | 12/1967 | Watkins | 166/87 |
| 3,601,190 | A | * | 8/1971 | Mott | 166/87.1 |
| 3,860,190 | A | * | 1/1975 | Bolick , Jr. | 242/610.1 |
| 4,333,526 | A | | 6/1982 | Watkins | 166/87 |
| 4,449,583 | A | | 5/1984 | Lawson | 166/72 |
| 4,807,700 | A | * | 2/1989 | Wilkins | 166/332.4 |
| 5,044,432 | A | | 9/1991 | Cunninham | 166/87 |
| 5,143,158 | A | | 9/1992 | Watkins | 166/344 |
| 5,687,794 | A | | 11/1997 | Watkins | 166/363 |
| 5,769,162 | A | * | 6/1998 | Bartlett et al. | 166/87.1 |
| 5,873,415 | A | * | 2/1999 | Edwards | 166/344 |
| 5,992,527 | A | * | 11/1999 | Garnham et al. | 166/379 |
| 6,488,083 | B2 | * | 12/2002 | Bartlett et al. | 166/87.1 |
| 2001/0045538 | A1 | * | 11/2001 | Cunningham | 251/62 |
| 2002/0153143 | A1 | * | 10/2002 | Compton et al. | 166/368 |

* cited by examiner

*Primary Examiner*—Hoang Dang
(74) *Attorney, Agent, or Firm*—Wendy Buskop; Buskop Law Group, P.C.

(57) ABSTRACT

An apparatus for use in a subsea well including a bore, wherein the apparatus has a tubing hanger body having an annulus therethrough, a ball valve in the annulus adapted for opening and closing the annulus, comprising a ball valve body within a valve chamber in the tubing hanger body which forms a continuation of the tubing hanger passageway at one end and is closed at its opposite end; a tubular valve housing for the ball valve; the ball valve body having a ball valve closure member substantially in the form of a spherical ball defining two annular valve seats concentric with the annulus for the ball valve; the spherical ball being longitudinally movable and rotatable extending transversely in alternating positions between spherical upstream and downstream valve seat preventing flow through the passage; and a remote source for hydraulically moving the spherical ball.

4 Claims, 4 Drawing Sheets

TUBING HANGER WITH BALL VALVE

BACKGROUND OF THE INVENTION

This invention relates to a subsea well housing installed at the ocean floor, a casing hanger connectable to the upper end of a casing string and supported in the bore of the housing to suspend the casing string in the well bore, and a tubing hanger connectable to the upper end of a tubular string and also supported within the housing bore for suspending the tubular string within the casing string and use of a ball valve for hydraulically controlling flow in a first embodiment, through passageway means in the tubing hanger which connects the annulus between the casing and tubular strings and the bore of the housing above the tubing hanger, and in a second embodiment, in the bore below the tubing hanger.

During the completion of an offshore well, the casing and tubing hangers are typically lowered into supported positions within the wellhead housing through a blowout preventer (BOP) stack installed above the housing. Then, following completion of the well, the BOP stack is replaced by a Christmas tree having suitable valves for controlling the production of well fluids.

In most versions of the tree assembly, the casing hanger is sealed off with respect to the housing bore and the tubing hanger with respect to the casing hanger or the housing bore, so that the tubing effectively forms a fluid barrier between the annulus, that is between the casing and tubular strings, and the bore of the housing above the tubing hanger. However, during completion of the well, as well as after completion of the well, there may be reasons to communicate between the annulus and housing bore and thus permit fluid circulation between them. The present invention relates to a tubing hanger with passageways connecting them and shutoff mechanisms for controlling flow through the passageways so that the passageways may be opened or closed and well fluid contained at least during those intervals in which the BOP stack or Christmas tree is removed.

Subsea tubing hangers having shutoff mechanisms of this general type are shown, for example, in U.S. Pat. Nos. 3,360,048, 4,335,526 and 4,449,583 as well as in U.S. Pat. Nos. 5687794, 5143158, 5044432 and 4333526. In most of the patents, however, as well as in other apparatus of this type, the passageways through the tubing hangers are typically controlled by a shutoff mechanism or a valve which has sealing parts of elastomeric material which may be damaged by extreme heat or other deleterious conditions of the well fluids.

Also, in the valves of certain of these patents, movement of the shutoff mechanism from closed to open positions requires the installation and manipulation of a separate tool which is cumbersome and subject to breaking and not hydraulic manipulation. Furthermore, in most situations, the shutoff mechanism is moved from closed to open positions by springs, which are highly susceptible to malfunction.

None of the shutoff mechanisms disclosed focus on the safety aspects of controlling fluid flow through use of a ball safety valve.

An object of this invention is to provide a safety valve, and in particular either a ball valve in a tubing hanger or disposed in a separate member below the tubing hanger body, which is hydraulically operable for controlling the passageway to minimize the possibility of leakage past the fluid barrier provided by the hanger.

An object of the invention is to provide a safety valve, which is so reliable and inexpensive to install, that the valve assembly has significant environmental advantages, and lower construction costs.

A further object of the invention is to provide a ball valve either integral within the tubing hanger or disposed in a separate member below the lower end of the tubing hanger body, which can be operated in a reliable manner, without requiring a single additional tool.

SUMMARY OF THE INVENTION

The present invention comprises an apparatus for use in a subsea well including a housing having a bore, wherein the apparatus comprises: a tubing hanger having an upper end and a lower end including a tubing hanger body having an annulus therethrough, connectable to the upper end of the tubing hanger on an tubular string which is adapted to be supported in the bore of the housing so as to suspend the tubular string therein; a ball valve disposed in the annulus, adapted for opening and closing the annulus, comprising a ball valve body disposed within a valve chamber in the tubing hanger body which forms a continuation of the first section of the tubing hanger passageway at one end and which is closed at its opposite end; a tubular valve housing for the ball valve; the ball valve body having a ball valve closure member substantially in the form of a spherical ball defining two annular valve seats concentric with the annulus for the ball valve; the spherical ball being longitudinally movable and rotatable extending transversely in alternating positions between spherical upstream valve seat and spherical downstream valve seat thereby preventing flow through the flow passage; and means responsive to pressurized fluid from a remote source for hydraulically moving the spherical ball from an open to a closed position and from a closed position to an open position.

Optionally, in another embodiment of the invention, the ball valve may be disposed in a separate member below the lower end of the tubing hanger body.

DETAILED DESCRIPTION OF THE PREFERRED EMBODIMENTS

Figure 1:
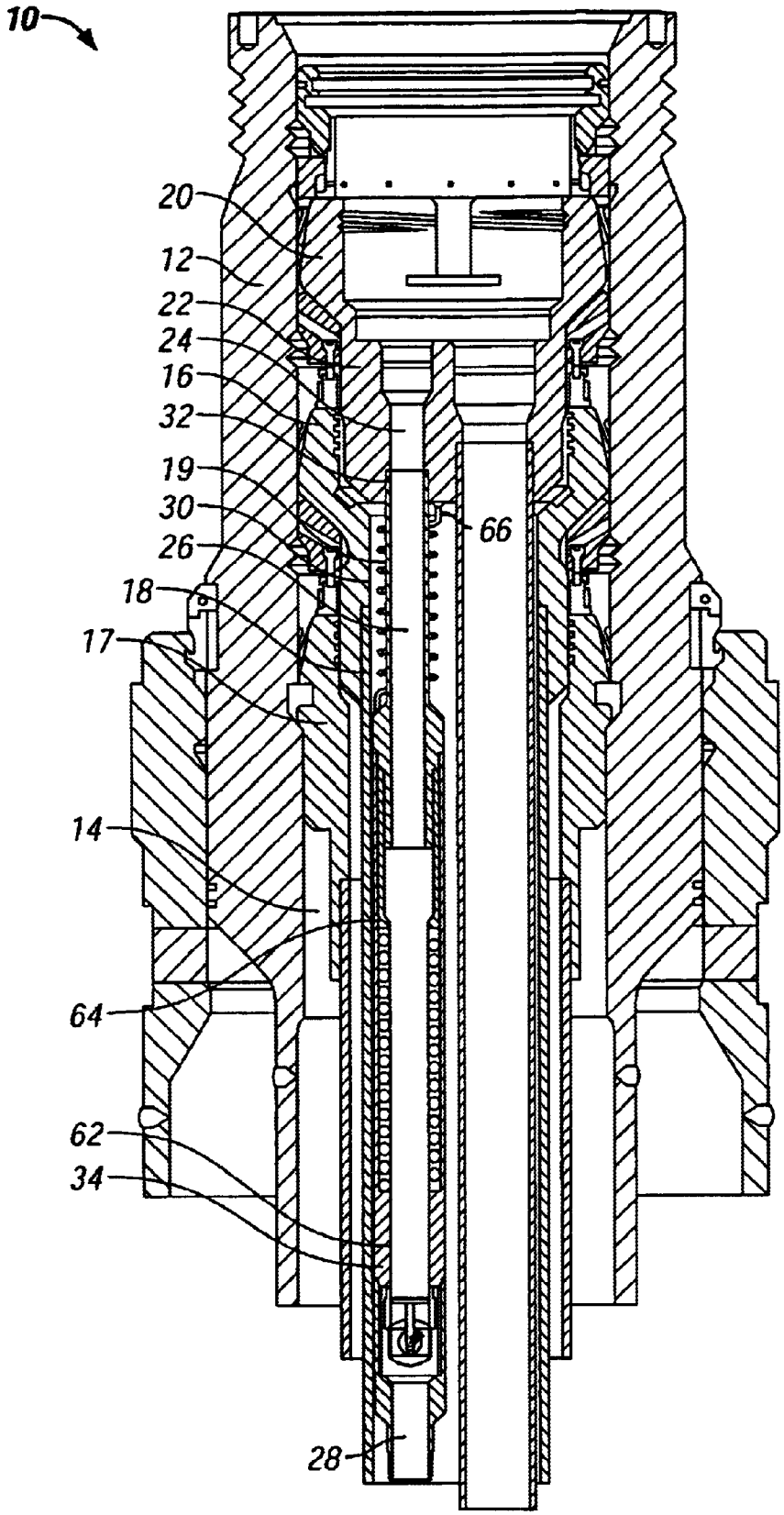
FIG. 1 is a cross section of a wellhead with tubing hanger with an installed ball valve.

In its preferred and illustrated embodiment, as shown in FIG. 1, a subsea well 10 has a housing 12 having a wellhead bore 14. At least one casing hanger 16 is supported within the wellhead bore 14 for suspending at least one casing string 18 within the wellhead bore 14. Also shown in FIG. 1, a second casing hanger 17 is supported within the wellhead bore 14 for suspending a second casing string within the wellhead bore 14.

The casing hanger 16 comprises a tubing hanger 20, which has a tubing hanger body 22, which can be, for example, in the shape of a metal dome received within an opening in the tubing hanger 20. The tubing hanger 20 contains a tubular string 19.

Figure 3:
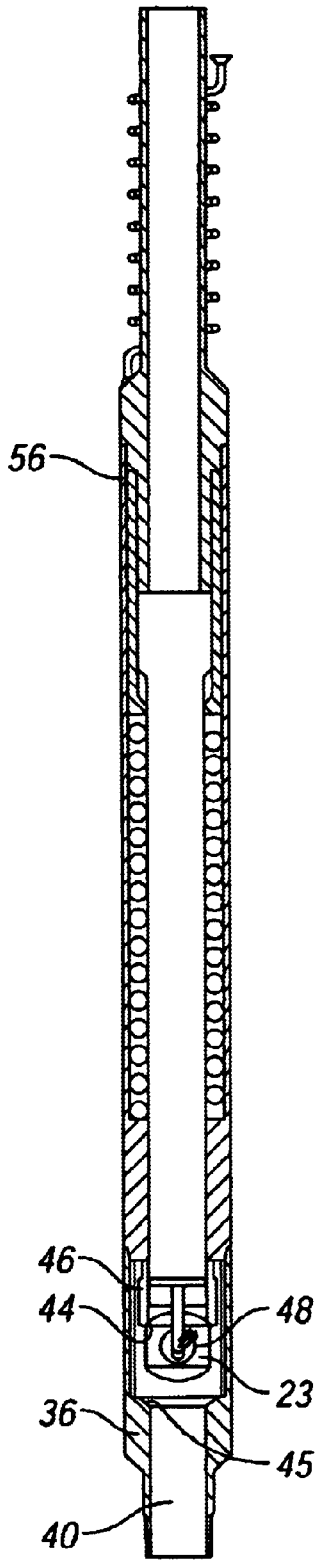
FIG. 3 is a detailed view of a bottom section of a tubing hanger with a ball valve installed, shown in the open valve position.

The tubing hanger body 22 could have a valve chamber 23, shown in FIG. 3, for containing the environmentally sound ball valve 34. Other types of safety valves may be used, but the ball valve is the preferred embodiment. The tubing hanger body 22 has a tubing hanger passageway 24, also know as the annulus, which has a first section 26 and a second section 28. The connection is through a port 32.

Figure 2:
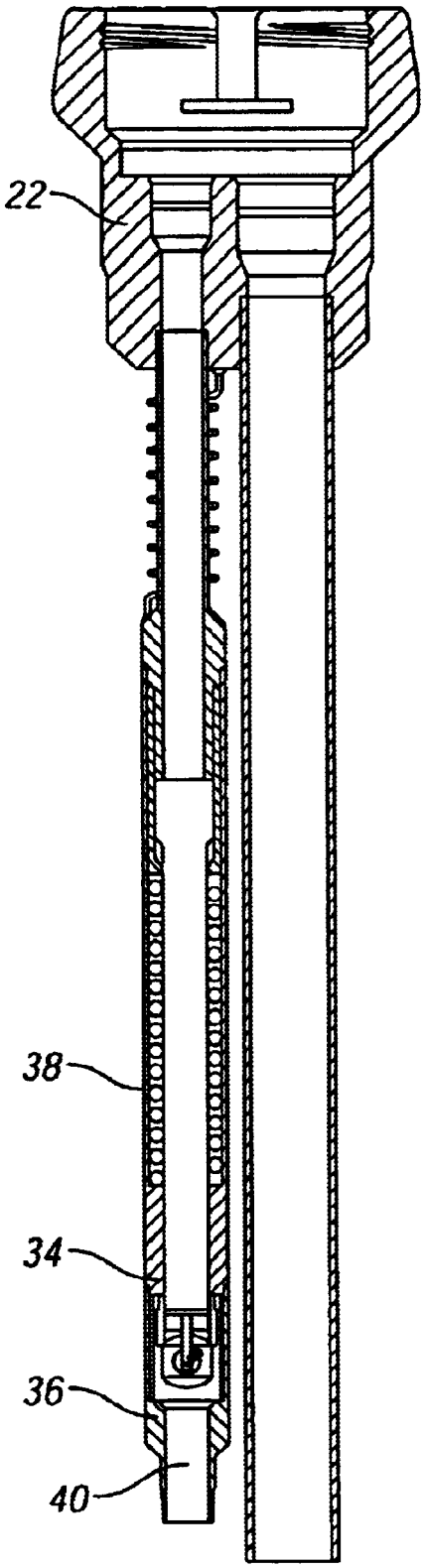
FIG. 2 is a cross section of the ball valve installed in the annulus passageway adjacent the wellhead bore.

As shown in FIG. 2, a ball valve 34 has a ball valve body 36 preferably consisting of a tubular valve housing 38 which has a flow passage 40. In an alternative embodiment, not shown, this passageway 40 can have two or more flow passageways or bores and two or more ball valves can be mounted in each passageway or bore, or in a space below the tubing hanger in each connecting passageway, or in at least one of those passageways, or bores.

It is contemplated as within the scope of the invention that one ball valve could be mounted so as to provide two valve closure members mounted in a plurality of passageways or bores, wherein both are controllable from one source.

Finally, it is contemplated that the ball valve 34 can be disposed in a separate member below the lower end of the tubing hanger body in the annulus or mounted below the lower end of the tubing hanger body in the annulus; and thus, provides the advantageous features and meets the objectives of this invention.

FIG. 3 shows the ball valve body 36 with a spherical upstream seat 45 along with spherical down stream seat 44 defines a downstream valve seat 46, which both seats are concentric to the flow passage 40 for the ball valve.

Figure 4:
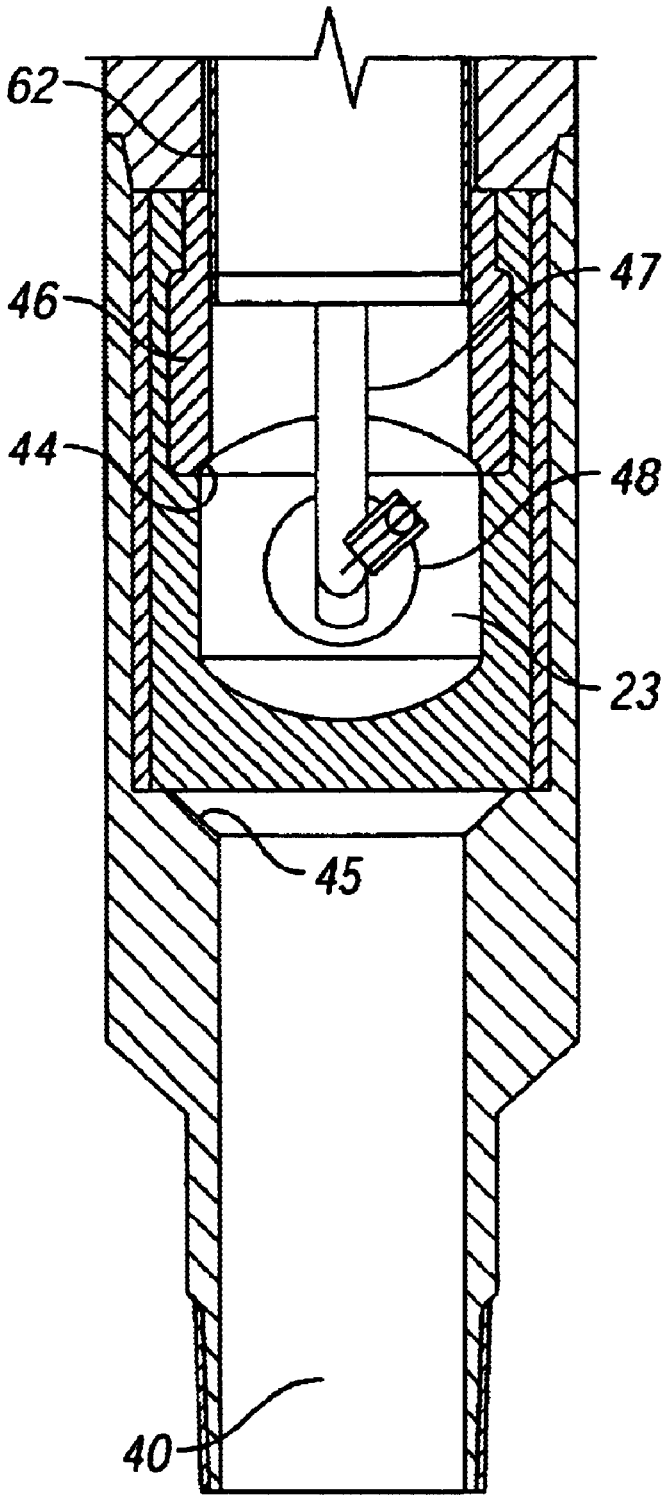
FIG. 4 is a detailed view of a bottom section of a tubing hanger with the ball valve installed, with the valve shown in the closed position.

FIG. 4 shows a ball 48 is disposed in the valve chamber 23 and provides rotatable movement to a valve closed position in which the ball 48 is applied to downstream spherical valve seat 44 to a valve closed position in which the ball 48 rotates alternatingly transversely across the flow passage and moves away from the upstream valve seat 45 closing fluid flow in the passage 40.

It is contemplated that the ball 48 is made from metal for the most environmentally advantageous version of the invention. However, it is possible that the ball 48 is made from a laminate, such as a graphite/metal laminate or laminate of other durable materials.

The ball valve 34 in the most preferred embodiment is operated by hydraulic actuator 56 as seen in FIG. 3, which can provide pressurized fluid from a remote source, such as a vessel at the surface of the sea. The hydraulic actuator or means 56 moves the ball valve from a closed to an open position. Ball valves, which can be used within the invention, can be acquired from suppliers, such as Halliburton, Baker Oil Field Tools, Camco or a similar supplier of ball safety valves, or similar styled safety valves.

FIG. 4 specifically shows the ball valve in the closed position. In yet another embodiment, control means 62 is located moveably within the passageway or bore. Control means 62 is for controlling the valve closure member 47.

In addition and returning to FIG. 1, a tubular piston 64 can be mounted on the ball valve 34 for latitude extension and retraction of the ball valve closure 47 of the valve from FIG. 3. This tubular piston 64 can be coupled to the control means 62 to extend the piston and close the passageway using the ball valve closure member 47.

Also shown in FIG. 1, fluid pressure can be injected from a remote source through fluid port 66, such as on the water surface or some point above the tubing hanger, into a fluid port 66 to hydraulically operate the safety valve such as the ball valve or similar safety valve. The pressurized fluid can be alternatively applied to or exhausted from the fluid port 66 in order to move the ball valve closure member 47 between its open and closed positions.

For the invention to operate it is best understood from. FIG. 4 that the radius of the curvature of the spherical downstream seat 44 of the ball valve must match the radius of curvature of the spherical ball 48, which is ball valve closure member 47, must permit nesting engagement of the two pieces for sealing engagements.

From the foregoing it will be seen that this invention is one well adapted to attain all of the ends and objects hereinabove set forth, together with other advantages which are obvious and which are inherent to the apparatus.

It will be understood that certain features and sub-combinations are of utility and may be employed without reference to other features and sub-combinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. For use in a subsea well including a housing having a bore, apparatus comprising:

a. a tubing hanger having an upper end and a lower end including a tubing hanger body having an annulus bore and a production bore therethrough, wherein the tubing hanger is connected to the lower end by a tubular string which is adapted to suspend in the bore; the annulus bore terminates near the lower end of the tubing hanger;

b. a ball valve disposed in said annulus bore, adapted for opening and dosing the annulus bore, comprising a ball valve body, wherein the ball valve body forms a continuation of a first section of the annulus bore at one end and wherein the ball valve body closes the annulus bore at its opposite end;

c. a tubular valve housing for said ball valve;

d. said ball valve body having a ball valve closure member substantilly in the form of a spherical ball abutting two annular valve seats located within said ball valve body;

e. said spherical ball being longitudinally movable and rotatable extending transversely in alternating positions between spherical upstream valve seat and spherical downstream valve seat thereby preventing flow through said annulus bore; and f. means responsive to pressurized fluid from a remote source for hydraulically moving the spherical ball.

2. The apparatus of claim 1, wherein said ball valve further comprises:

a. control means movably disposed within said annulus bore for controlling movement of the spherical ball;

b. a tubular piston movably mounted in said ball valve for longitudinal extension and retraction, said tubular piston being coupled to said control means for extending said tubular piston relative to said control means; and c. a fluid port through which the pressurized fluid from a the remote source above the tubing hanger may be alternately applied to or exhausted from in order to move the valve closure member between the open and closed positions.

3. For use in a subsea well including a housing having a bore, apparatus comprising:

a. a tubing hanger having an upper end and a lower end including a tubing hanger body having an annulus bore and a production bore therethrough, wherein the tubing hanger is connected to the lower end by a tubular string which is adapted to suspend in the bore; the annulus bore terminates near the lower end of the tubing hanger;

b. a ball valve disposed in a separate member below said lower end of said tubing hanger body in said annulus bore, adapted for opening and closing said annulus bore, comprising a ball valve body, wherein the ball valve body forms a continuation of a first section of the annulus bore at one end and wherein the ball valve body closes the annulus bore at its opposite end;

c. a tubular valve housing for said ball valve;

d. said ball valve body having a ball valve closure member substantially in the form of a spherical ball abutting two annular valve seats located within said ball valve body;

e. said spherical ball being longitudinally movable and rotatable extending transversely in alternating positions between spherical upstream valve seat and spherical downstream valve seat thereby preventing flow through said annulus bore; and f. means responsive to pressurized fluid from a remote source for hydraulically moving the spherical ball.

4. The apparatus of claim 3, wherein said ball valve further comprises:

a. control means movably disposed within said annulus bore for controlling movement of the spherical ball;

b. a tubular piston movably mounted in said ball valve for longitudinal extension and retraction, said tubular piston being coupled to said control means for extending said tubular piston relative to said control means; and c. a fluid port through which the pressurized fluid from the remote source above the tubing hanger may be alternately applied to or exhausted from in order to move the valve closure member between the open and closed positions.

* * * * *